United States Patent [19]

Jacobson

[11] 4,417,424

[45] Nov. 29, 1983

[54] SEGMENTED EXTENDIBLE BOOM

[76] Inventor: Darwin J. Jacobson, P.O. Box 962, Port Angeles, Wash. 98362

[21] Appl. No.: 390,639

[22] Filed: Jun. 21, 1982

Related U.S. Application Data

[63] Continuation of Ser. No. 110,173, Jan. 7, 1980, abandoned.

[51] Int. Cl.[2] ..... E04H 12/00

[52] U.S. Cl. ..... 52/108; 52/632; 182/41

[58] Field of Search ..... 52/108; 182/40, 41, 182/66, 107, 207; 212/266–269, 231, 230

[56] References Cited

U.S. PATENT DOCUMENTS

| | | | |
|---|---|---|---|
| 209,971 | 11/1878 | Juengst et al. | 182/41 |
| 313,387 | 3/1885 | Trimble | 182/41 |
| 328,345 | 10/1885 | Sees | 182/41 |
| 598,615 | 2/1898 | Miley | 182/41 |
| 991,401 | 2/1911 | White | 182/41 |
| 1,888,181 | 11/1932 | Riesbol | 52/632 |
| 2,946,556 | 7/1960 | Edgerton . | |
| 3,234,698 | 2/1966 | Kimblern | 52/108 |
| 3,319,803 | 5/1967 | Northcott | 212/267 |
| 3,337,001 | 8/1967 | Huska et al. | 182/207 |
| 3,420,331 | 1/1969 | Minnite | 182/41 |
| 3,708,937 | 1/1973 | Sterner | 52/731 |

FOREIGN PATENT DOCUMENTS

| | | | |
|---|---|---|---|
| 1281651 | 10/1968 | Fed. Rep. of Germany | 212/269 |
| 1288867 | 2/1969 | Fed. Rep. of Germany | 242/54 R |
| 1508937 | 11/1967 | France | 52/108 |
| 761402 | 11/1956 | United Kingdom | 52/108 |
| 565738 | 5/1975 | U.S.S.R. | 242/54 R |

*Primary Examiner*—James L. Ridgill, Jr.
*Attorney, Agent, or Firm*—Seed and Berry

[57] ABSTRACT

A longitudinally extendible, segmented boom structure includes a plurality of hollow, substantially V-shaped segments which are pivotally connected to adjacent segments for storage. A series of load-bearing cables extend through the segments for carrying loads. The segments have uniform cross-sections and progressively increasing lengths. Segments are stored in rolled-up form on a reel by pivoting the segments to form a coil of nesting segments. Each segment has laterally extending side flanges through which longitudinally extend the pre-tensioned load-bearing cables. The cables pass through the flanges on opposite sides of the boom segments for supporting vertical loads and resisting side loads on the boom. A second set of auxiliary cables on the underside of the boom is automatically payed out as the boom is extended. The auxiliary cables prevent the extended segments from collapsing when inverted. The center point of the segment reel is adjusted in elevation to automatically feed boom segments at an optimum angle into a segment dispenser and boom support structure which has rollers thereupon for cooperating with corresponding lands and grooves on the segment flanges.

20 Claims, 13 Drawing Figures

FIG. 9
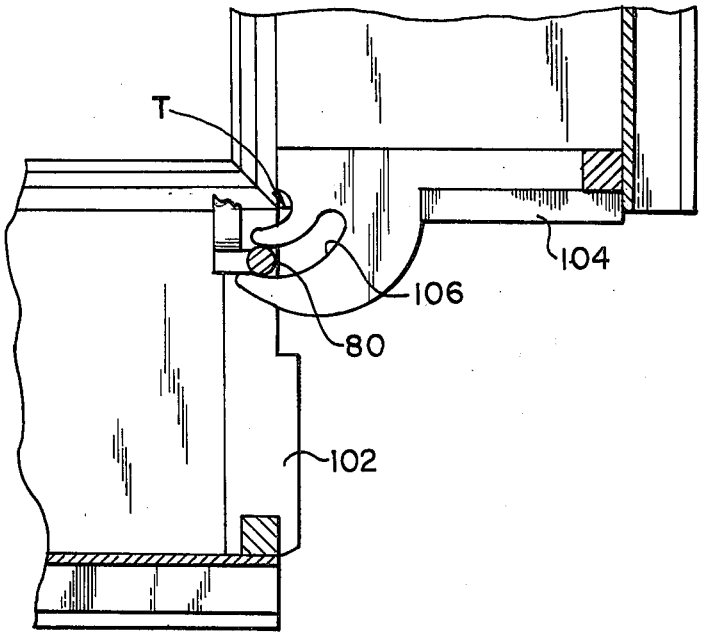
FIG. 12A
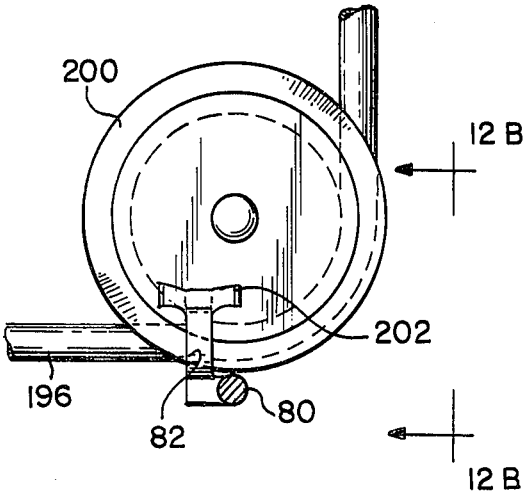
FIG. 10
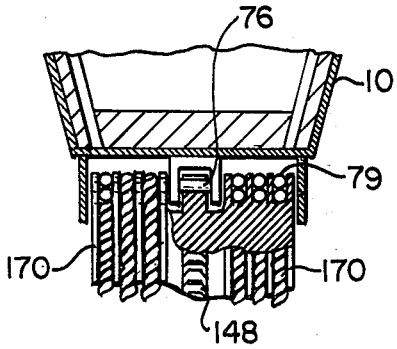
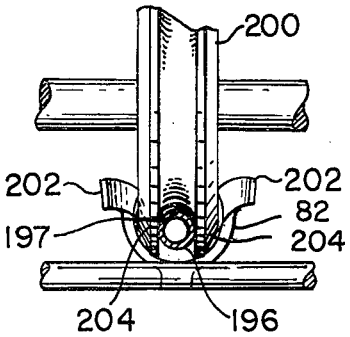
FIG. 12B
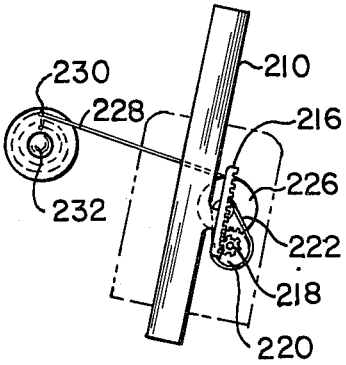
FIG. 11

SEGMENTED EXTENDIBLE BOOM

This application is a continuation of U.S. patent application Ser. No. 110,173, filed Jan. 7, 1980, now abandoned.

BACKGROUND OF THE INVENTION

1. Field of the Invention

This invention relates to extendible boom structures and, more particularly to boom structures having articulated segments which can be coiled for storage.

2. Prior Art

Mechanisms for storing the elements of an extendible, segmented boom structure in a coiled configuration on a reel are known in the prior art. For example, U.S. Pat. No. 3,179,267 discloses a plurality of segment links, each segment having a different shape. The segments taper inwardly from the inner to the outer end of the boom so that the segments are not uniform and the outer segments have a smaller cross-sectional area. The segments are joined together with heavy-duty pin joints which, in operation, carry the loading forces exerted on the boom. The segments are coiled for storage in a magazine and guided within the magazine by tracks engaging the ends of the pins joining the segments. This type of boom provides no additional mechanisms or structural elements for strengthening the boom so that the capacity of the boom is limited by the strength of the smallest end segments. The segments are not provided with cables to assist the boom in carrying a load. If this type of boom is inverted, it will collapse and cannot be used in an inverted position since the pivot joints between segments are pin joints, no provisions are made for protecting the joints when they are overloaded. Nothing in this type of boom design provides additional strength for handling side loads.

SUMMARY OF THE INVENTION

It is an object of the invention to provide an improved extendible, segmented boom structure which stores the segments in a nesting relationship.

It is another object of the invention to provide a segmented extendible boom structure which has nesting boom segments having the same cross-section.

It is another object of the invention to provide segments for an extendible boom structure which are elastically hinged together to resist overloads and which are strengthened by pre-tensioned, integrally mounted cables for carrying the boom loads.

It is a further object of the invention to provide a segmented structure for an extendible boom which provides for pivotable interconnection, resists twisting and racking and has high strength against lateral loads.

It is a still further object of the invention to provide an automatically dispensed cable for the extended boom which maintains the boom segments in an extended relationship when the boom is turned over.

In accordance with these and other objects of the invention, an extendible, segmented boom is provided having boom segments of uniform cross-section. The boom is strengthened by means of pre-stressed cables which integrally pass through laterally extending flanges on each segment. This provides strength to the boom for vertical loads. The placement of the pre-tensioned cables within the laterally located flanges also provides resistance to side forces on the boom. Another set of cables prevents the pivotally coupled segments from pivoting away from each other when the boom is turned upside down, providing an important safety feature for the boom.

The boom structure includes a plurality of hollow, truncated V-shaped segments. The segments are uniform in transverse cross-section with the longitudinal lengths of adjacent pairs being progressively smaller. The uniform transverse cross-sections of the segments facilitate fabrication of the segments. The progressively smaller longitudinal pair lengths and the hollow configuration of the segments permit a boom to be compactly stored in a magazine. The boom segments are pivotally connected for movement about transverse axes. The V-shaped segments terminate at the wide ends in laterally extending flanges which contain the pre-stressed flexible cables which are integrally connected to each of the flanges and are loaded at the outer extremities of the segments. The cables support vertical loads on the boom. Because of their spacing at the outer extremity of the segments, the cables also resist side loading on the boom.

The boom segments when coiled nest within each other to form a generally square configuration with the progressively smaller boom segments located near the center of the configuration. The boom coiling structure has a central axle about which the segments are coiled. The coil is automatically lowered and raised as the segments are uncoiled or coiled, respectively, to provide an optimum angle of insertion or retraction of the boom segments. As the boom segments are dispensed from the storage magazine, a spring is wound up to provide a return force for retracting the boom segments into the magazine. The interconnected extendible adjacent boom segments wedge together at their sides so as to resist relative side and longitudinal twisting movement of the segments. A second cable is provided for supporting the boom segments when the boom is turned upside down. This cable prevents the pivotal movement of the segments. Clips are provided within the hollow portion of the segments for carrying power cables and the like to the end of the boom. The power cables are automatically fed into the clips as the boom is extended. The boom extension and retraction apparatus is constructed so that it can be varied in elevation by positioning the boom in a vertical direction in contact with the support underlying the entire structure. The boom can then be extended or retracted to fix the elevation of the entire structure with respect to the underlying support base. The boom is then locked into vertical position.

BRIEF DESCRIPTION OF THE DRAWINGS

FIG. 9 is a view showing two adjacent segments pivoted with respect to each other;

FIG. 10 is a sectional view of a boom segment and sprocket gear taken along sectional line 10—10 of FIG. 3;

FIG. 11 is a diagrammatical representation of the boom elevation apparatus;

FIG. 12*a* is a side view of an auxiliary hose guide means; and

FIG. 12*b* is a front view of the auxiliary hose guide means.

DETAILED DESCRIPTION OF THE PREFERRED EMBODIMENT

Figure 1:
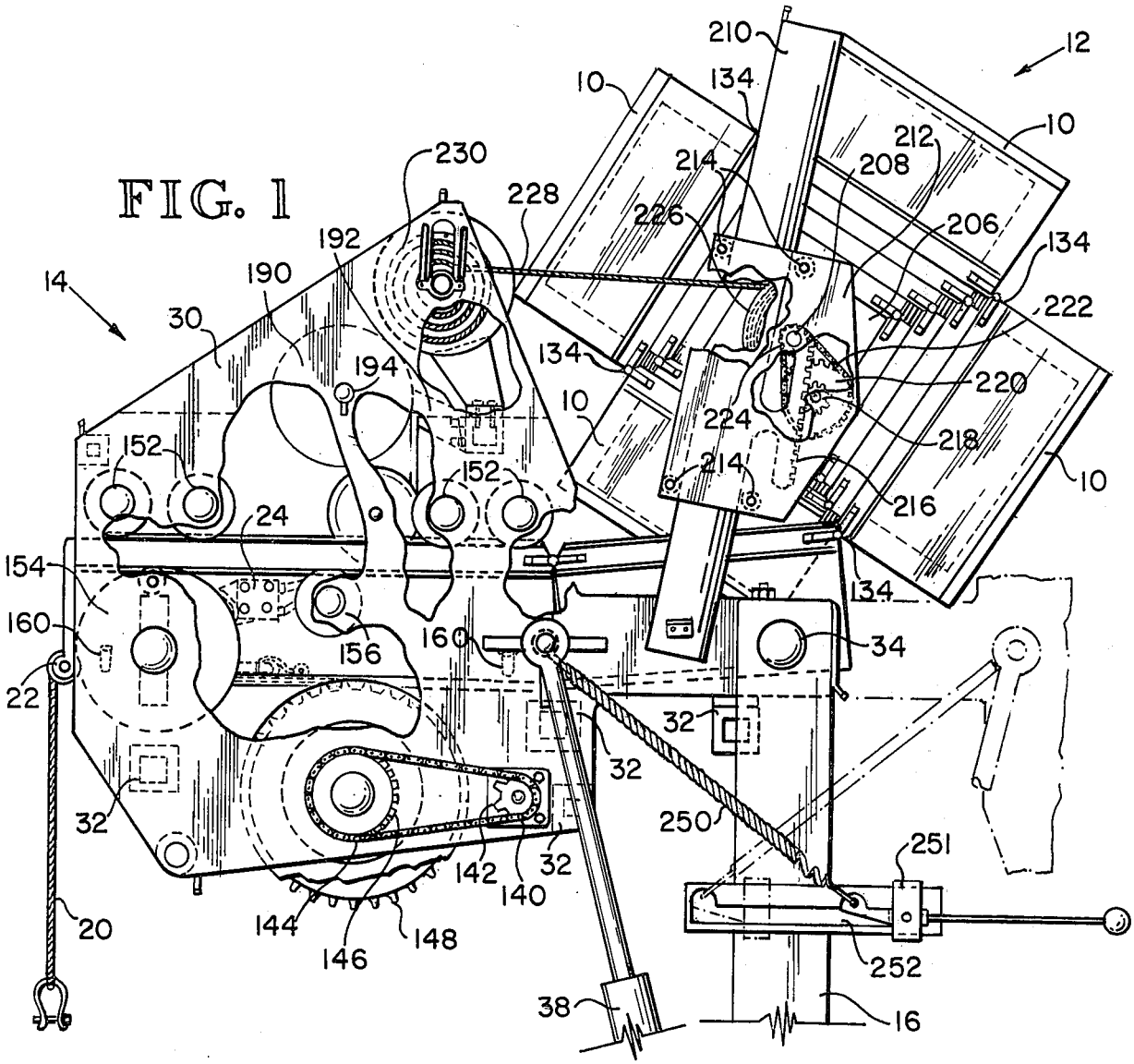
FIG. 1 is a partially cut-away side elevation view of an assembled segmented extendible boom apparatus with the boom segments in a coiled, retracted arrangement.
Figure 1:
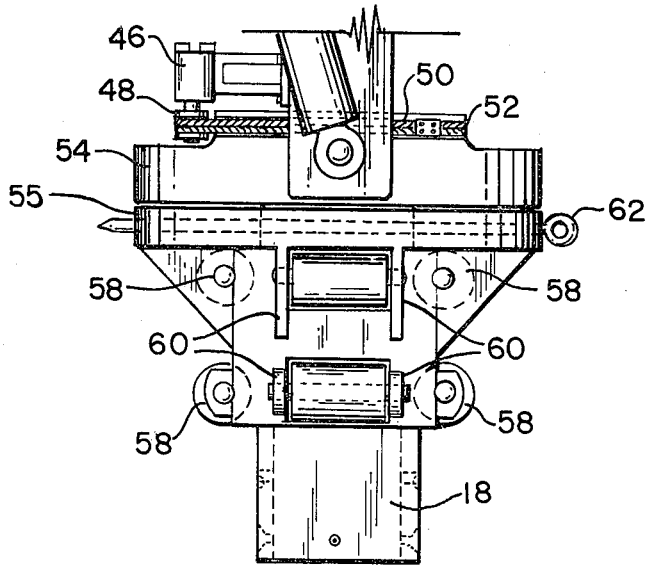

Referring to FIG. 1, a segmented extendible boom includes a plurality of boom segments 10 which are compactly stored in a storage assembly 12. The boom segments are extended or retracted by means of a segment support and driver assembly 14, which in turn is mounted to a fork-shaped support frame 16 also shown in FIG. 2. The frame 16 is rotated with respect to a support post 18. The support post is fixed to a support base. The apparatus shown provides means for extending and positioning a boom formed from a plurality of segments 10. The boom has, for example, a hoist cable 20 positioned at the end thereof for handling and hoisting of loads. The hoist cable 20 passes over a hoist sheave 22. A conventional hoist motor and winch assembly 24 is shown as a typical means of controlling the hoise cable 20.

SEGMENT SUPPORT AND DRIVE ASSEMBLY

Figure 2:
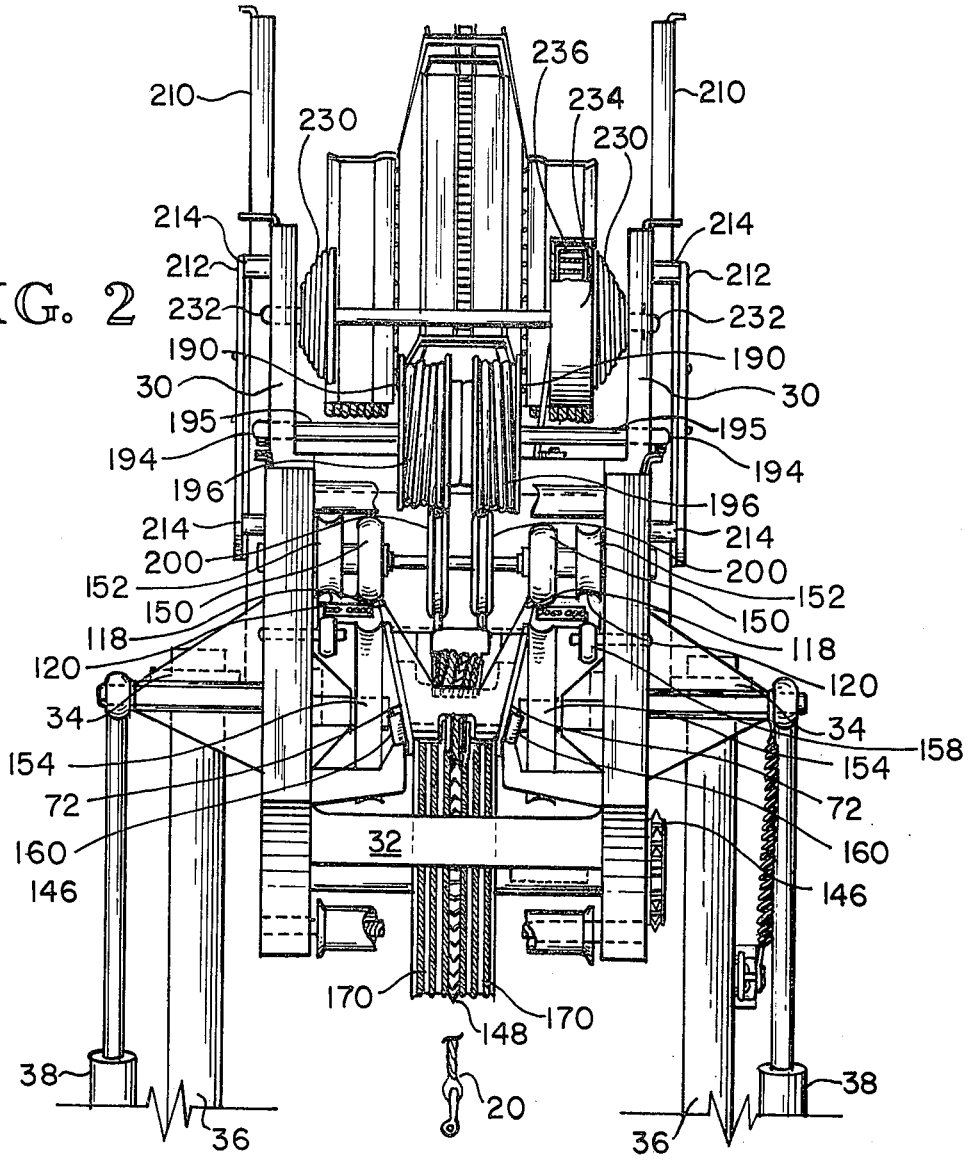
FIG. 2 is a front elevation view of a segmented extendible boom assembly.
Figure 2:
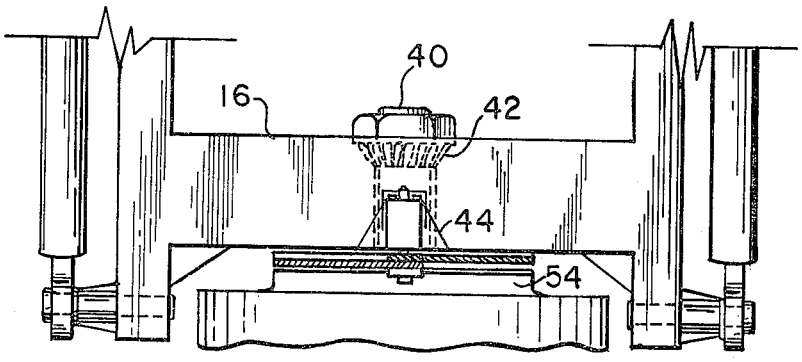

The boom segment support and drive assembly 14 includes a frame formed from a pair of side plates 30 which are maintained in a spaced-apart relationship by means of a plurality of cross-brace members 32 which are welded or otherwise suitably fastened to the side plates to provide a rigid suppport. frame. As shown in FIGS. 1 and 2, the support frame is pivotal about pins 34 which extend through appropriate apertures at the ends of the extending arms 36 of the fork-shaped frame 16. Two hydraulic cylinders 38 are each pivotally connected at one end to the frame 16 and at the other end to brackets projecting from the support and drive assembly 14 as shown. The cylinders permit the angle of elevation of the boom to be adjusted to a desired setting. The boom may be flipped all the way over to provide a low profile for storage or transportation.

The forked frame 16 pivots about a center pin 40 on bearings 42, 44 and is rotated by means of a swing motor 46 which drives a pulley 48. A drive cable 50 driven by the pulley 48 engages a groove 52 extending around the top portion of a base 54. Rollers 58 are mounted on tabs 60 which project from a support 55 fixed to a deck or the like and the rollers guide the post 18. The height of the entire boom assembly is adjustable and the base 54 is positioned at various points by means of a lock pin 62 which passes through the support 55 and one of a plurality of vertically spaced apertures on the post 18, which post is adapted to have additional extensions connected thereto.

The Boom Segments

Figure 6:
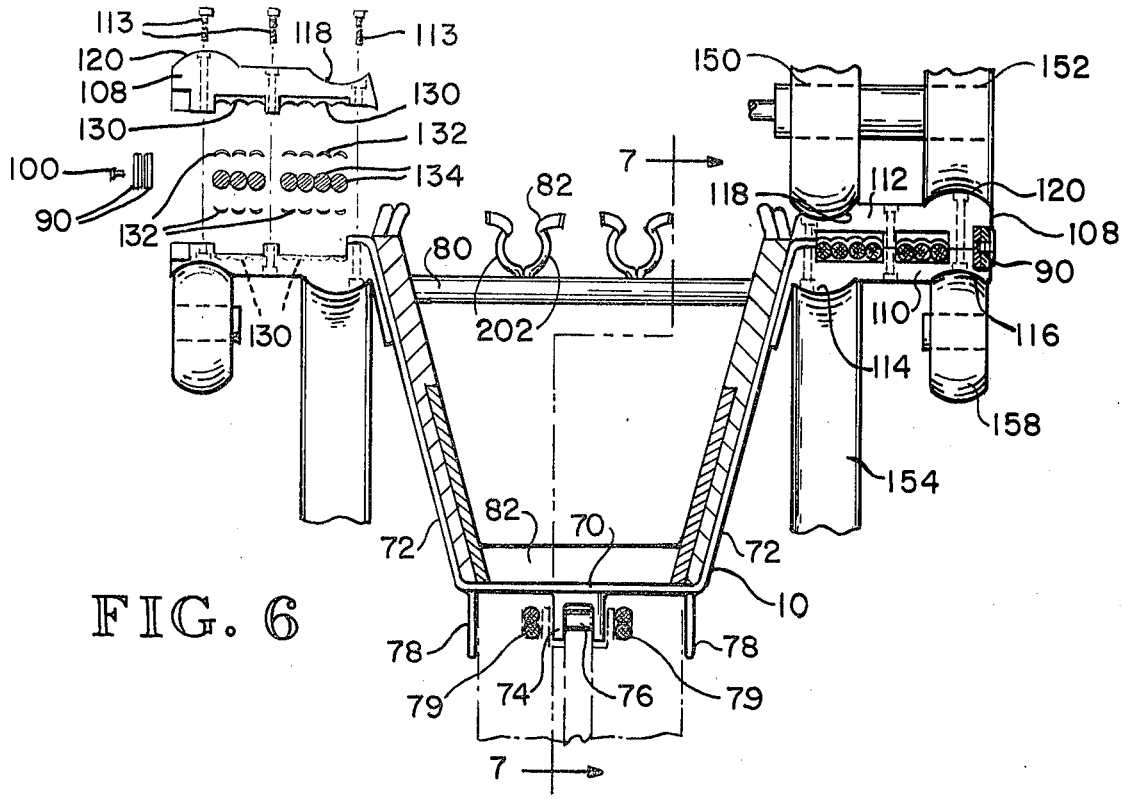
FIG. 6 is a partially exploded cross-sectional view of a boom segment shown engaging the support rollers of the retraction apparatus.
Figure 7:
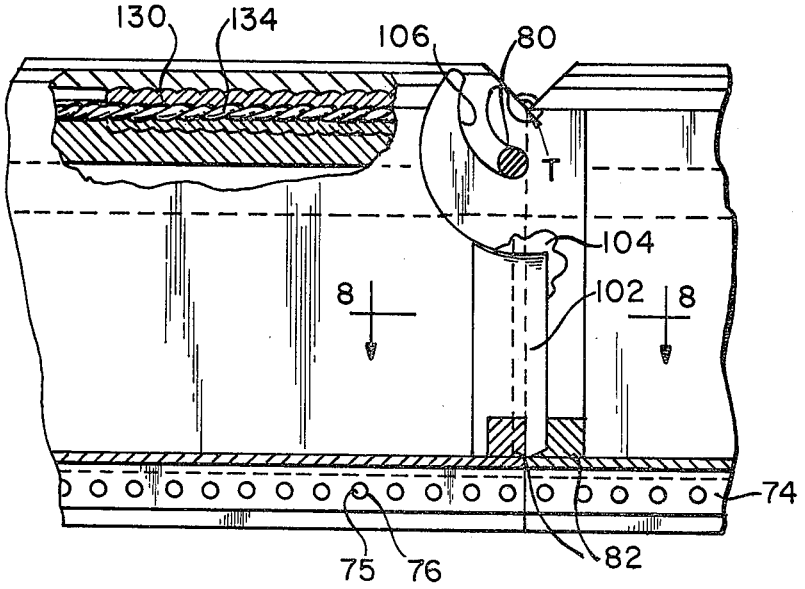
FIG. 7 is a partially cut away sectional view of portions of two adjacent engaged boom segments taken along section line 7—7 of FIG. 6.

The construction of a boom segment 10 is shown in cross section in FIG. 6. Each of the segments 10 has a uniform cross-sectional configuration and the segments differ only in length. Fabrication of the segments is simplified by using standardized segments. The strength of each segment is the same as the other segments, wherever located in the boom. Each segment 10 is a truncated V-shaped structure which includes a generally flat bottom portion 70 with side walls 72 extending upwardly and at oblique angles to the flat bottom portion 70. Extending longitudinally along the outside of the flat bottom portion 70 is a pintle rail 74 having a generally hollow interior as shown. Holes 75 as shown in FIG. 7 are provided in the rail 74 at uniform spacings for receiving pins, or pintles 76. The pintles 76 form a rack which is engaged by a gear for driving the segments in a longitudinal direction. A pair of downwardly extending flanges 78 are formed near the outside edge of each of the flat bottom plates 70 for each segment. These flanges cooperate with the pintle rail to provide a pair of cable troughs for a plurality of auxiliary cables 79. Laterally extending reinforcement ribs 82 are provided along the bottom plate 70 near the longitudinal ends of each segment 10. Welded in place near the top and at one end of each segment 10 is a rod, or cross member 80, to which are affixed clamps 82 for cables, hoses, and the like. Each clamp 82 has two segments which spring together to hold, for example, an electrical cable or a pneumatic hose providing power to operate the hoist motor or the like, as required.

Figure 3:
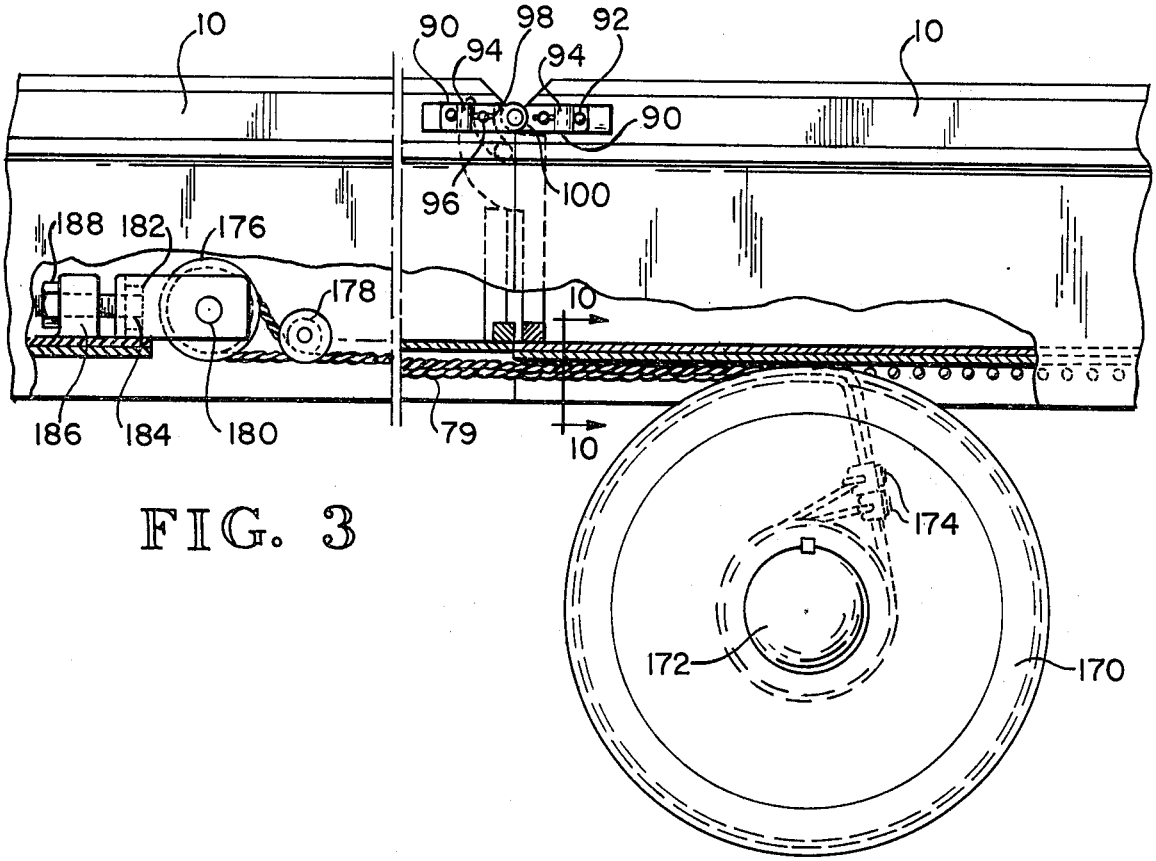
FIG. 3 is a partially cut-away side view of the first and second outermost boom segments with the drive sprocket gear engaging the second boom segment.

FIGS. 3, 7 and 9 show some of the details for pivotal connection of adjacent segments. The transverse axis about which adjacent segments pivot extends perpendicularly inward at location T of FIGS. 7 and 9. The pivotal connection of the segments 10 is utilized primarily in storing the segments and is accomplished by means of a pair of elastically extendible hinge straps 90, as shown in FIG. 3. Because the heavy loading on the boom is carried by a series of cables, the hinges are not necessarily required to be heavy duty. One end of each of the straps 90 or riveted by means of a rivet 92 to the exterior wall of the segment as shown. An outwardly bowed spring portion 94 is provided on each strap 90 which permits each strap 90 to be elastically lengthwise extended. Pins 96 engage elongated slots 98 formed in the straps to permit elastic lengthwise extension of the straps. Two straps are joined together by means of hinge pins 100 so that the longitudinal axes of adjacent segments 10 are pivotal about the hinge pins 100 lying along transverse axes by as much as 90° as shown in FIG. 9 of the drawing. The elasticity of the hinge straps permits the abutting ends of the segments 10 to move slightly apart if an overload force is applied against the segments 10 to prevent damage to the segments and joints and to provide a safety factor when the support cables are stretched by heavy loading.

Figure 8:
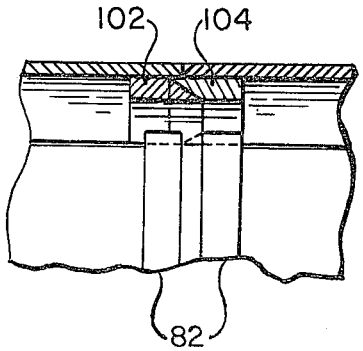
FIG. 8 is a sectional view of the interlocking wedges of two adjacent boom segments taken along section line 8—8 of FIG. 7.

Each of the boom segments 10 is guided and locked end-to-end in an abutting relationship with adjacent segments. The segments are guided together by means of the angled plates 102, 104 shown in FIGS. 7 and 8. FIGS. 7 and 9 show an outwardly extending end portion of the rod 80 engaged by a cam-slot 106 formed in a projecting end portion of each segment 10. FIG. 9 shows a rod 80 positioned at the entrance of the cam-slot 106. As the segments 10 are pivoted together, the rod 80 rides within the slot 106 and guides the angle plates 102, 104 into an engaging relationship as shown in FIG. 8. When the angle plates are engaged, lateral movement of the adjacent segments is prevented.

FIG. 6 shows a cross-sectional end view of a boom segment 10 having a pair of oppositely extending flanges 108 located at the wider end of each segment. Each flange has a lower half 110 and an upper half 112. The flange lower half 110 is fixed to the exterior wall of a segment. The halves 110, 112 of each flange contain corresponding countersunk apertures for receiving fastening hardware such as nuts and bolts or rivets 113. Located at the outer extremities of the flange half are the hinge straps 90, previously described. Each flange lower half 110 has a raised convex portion 114 and a grooved concave portion 116 which extend the length of the flange. Similarly, each flange upper half 112 has a grooved concave portion 118 and a raised convex portion 120. The convex portions provide some additional strengthening to the flanges in areas of greater stress under heavy loading. The raised and the grooved portions engage oppositely formed portions of guide and support rollers described below.

FIGS. 6 and 7 show a plurality of longitudinally extending ribs 130 formed in the upper and lower halves 110, 112 of the flanges 108. A plurality of half-sleeve members 132 fit in the slots formed between the ribs 130. Each half-sleeve 132 engages and clamps one side of one of a plurality of longitudinally extending stress cables 134 (typically shown). When the upper and lower halves 110, 112 of the flanges 108 are assembled together with the half-sleeve 132, the main stress cables 134 and sandwiched and held within the flanges 108. The main stress cables 134 extend the length of the boom from segment to segment and are tensioned to support the boom. When the segments are extended the cables 134 are placed in tension and provide the main strength for supporting vertical loads on the boom. The cables are not clamped adjacent the hinge points to allow free flexing of the cable to minimize sharp angles and abrasion.

Figure 4:
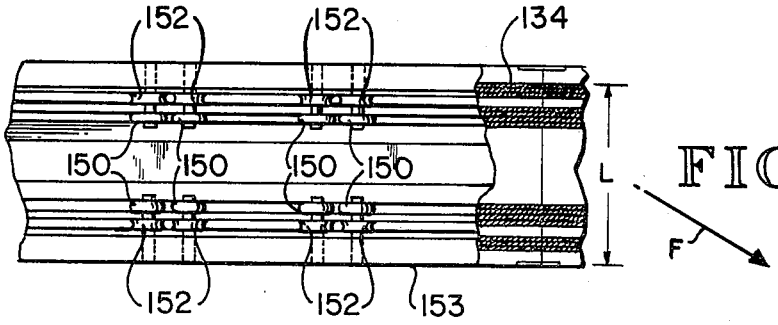
FIG. 4 is a top, partially cut-away view of the forward portion of the upper roller part of the boom retraction apparatus shown engaging the top surfaces of a boom segment.
Figure 5:
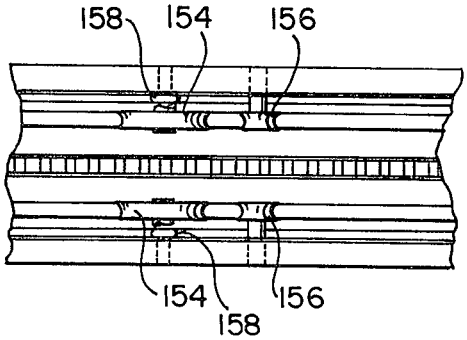
FIG. 5 is a view of the bottom rollers of the boom retraction apparatus shown contacting the lower surfaces of a boom segment.

FIG. 4 shows a force vector F having a side-load force component on the boom. The cutaway section of the boom segment shows the main stress cables 134. The side-load force component creates a moment tending to laterally pivot the boom segments about the side 153. The cables 134 provide forces opposing lateral pivoting. The cable furthest from the side 153 has a moment arm L and the other cables also have smaller moment arms. All of the cables with their corresponding moment arms provide moments opposing lateral pivoting of the boom. Thus the wide transverse width of the flanges increase the effective moment arms of the cables to advantagely withstand lateral loads. These moments provided by the cables 134 are in addition to the forces provided by the structural design of the segments alone.

Boom Support Means

Referring to FIGS. 1 and 2, boom segments 10 are driven inwardly and outwardly from the boom support means 14 by means of a main boom drive hydraulic motor 140 having a drive sprocket gear 142 connected thereto. The drive sprocket gear 142 engages a drive chain 144 which, in turn, engages a driven sprocket 146 which is affixed to the main boom segment drive pinion gear 148, the teeth of which engage the pintles 76 forming the rack on the bottom of the boom segments 10. The boom segments are thus moved inwardly and outwardly by a rack and pinion arrangement. The boom segments 10 are guided and supported within the boom support means 14 by a plurality of rollers. Side rollers 160 contact the upwardly extending sides 72 of the segments 10 as shown in FIGS. 1 and 2.

FIGS. 1, 2 and 6 show a plurality of rollers, each of which is spaced and aligned for support of the boom segment flanges. All of the rollers described herein are appropriately mounted using conventional bearings and mountings. FIGS. 2 and 4 show the top inside rollers 150 having convex external surfaces which mate with corresponding concave surfaces 118 on the boom segment flanges. The top inside rollers 152 have concave external surfaces which match the convex raised surfaces 120 formed on the flanges.

The lower surface of the flanges are engaged by a pair of large inside rollers 154 having a concave exterior surface which mates with the corresponding convex surface 114 of the flange and lower half 110 as shown in FIGS. 1, 2, 5, and 6. A pair of smaller inside rollers 156 are aligned in the same line of direction as the rollers 154. A pair of outside convex lower rollers 158 engage the concave portions 116 of the flange lower half 110.

The rollers as described above provide support for the boom when it is extended and serve as guides for extending and retracting the boom segments 10.

The Auxiliary Cable

Referring to FIGS. 3 and 6, the auxiliary cables 79 are stored on a drum 170 which is concentric with the main boom drive pinion gear 148. The cables are shown in FIG. 6. FIG. 3 shows the free ends of a cable 79 looped and fastened around the axle 172 of the drum 170 with cable fasteners 174. A cable 79 is fed through an aperture in the grooved surface of the drum 170. A cable 79 is laid within the groove so that one portion of the cable overlays the other portion. The cables 79 are payed out from the grooves on the drums 170 into the longitudinally extending cable troughs along the bottom of the segments. The cables extend out to the endmost section as shown in FIG. 3 and each cables passes around sheaves 176, 178. The sheaves 176 rotate about an axle 180 which is supported by a bracket 182. The position of the bracket is adjusted relative to the segment by means of an adjustment screw 184 which passes through the end of the adjustment bracket 182, through a block 186 fastened to the segment 10 and into an adjustment nut 188. The longitudinal position of the bracket 182 is adjusted to provide sufficient tension on the cables 79. The length of the wraps of cable 79 around the drum 170 is approximately equal to the boom segment lengths. Because the inner cable wrap has a diameter slightly less than the diameter of the outer cable wrap, the outer cable wrap is somewhat longer than the inner cable wrap and the sheave 176 permits the lengths to be equalized.

The purpose of the auxiliary cables 79 is to maintain the boom segments 10 in their extended positions when the boom is turned over or when an upward force is exerted against the boom. Without the cables 79, the boom segments 10 would pivot about their pivot pins 100 and collapse the boom. The cables 79 thus serve as safety cables and also permit the boom to be used in an inverted position. FIG. 10 of the drawing shows a sectional view of a boom segment, the drum 170 and the driven pinion gear 148.

Auxiliary Reel Means

FIGS. 1 and 2 show an auxiliary hose storage reel 190 mounted on a bracket 192. Hydraulic swivel couplings 194 provide fluid connection between external hydraulic hoses (not shown) and a hollow hose reel shaft 195. The hollow shaft 195 is connected to hydraulic hoses 196 coiled on each of the reels 190. It is readily apparent that other auxiliary hoses, cables and the like may be stored on the reels 190 as required. The cables, hoses, or the like stored on said reels are used for a variety of auxiliary functions such as, for example, operating a hoist motor or winch at the end of the boom. Means are provided for automatically feeding the hoses 196 into the clips 82 which extend upwardly from the rods 80 on each of the boom segments 10. This means includes a pair of feed wheels 200 rotatably positioned beneath the storage reels 190. FIGS. 12A and 12B show a feed wheel 200 having a portion of a hose 196 contained within a groove 197 extending around the periphery of said wheel as shown. The spring clips 82 have resilient, opposing side spring members 202 which are normally biased together to hold a hose or the like therebetween. In FIG. 12B, the feed wheel 200 is shown to have tapered edges 204 formed next to the circumferential peripheral groove 197. The tapered sides 204 of the feed wheel open the flexible arms of the clip 82 as it moves past the feed wheel 200 and the hose 196 is placed between the arms. As the hose clip 82 moves away from the wheel 200, the resilient arms 202 spring together and hold the hose 196 in position on a boom segment. When the boom is inverted, the clips 82 securely hold the hoses in position.

Segment Storage

FIG. 1 shows the segment storage means 12 having the interconnected boom segments 10 coiled in multiple wraps around a core 206. The segments 10 form a generally square configuration around the core 206 and the core 206 rotates on an axis formed by an axle 208. The ends of the cables 134 are fixed to the core 206.

The lengths of the segments 10 are chosen to have the segments compactly nest together. As an example, the sides of the core are eight inches in length. Each segment increases the thickness of the configuration by two inches. The first segment on the core is nine inches long. The second and third segments are 10 inches long. The fourth and fifth segments are 12 inches long. This sequence is continued to provide the square configuration on the core 206 as shown in FIG. 1.

The entire segment storage assembly 12 moves up and down along the storage assembly support posts 210 as shown in FIGS. 1, 2 and 11. The core support axle 208 extends through a pair of slideable brackets 212, each of which is mounted for movement on one of the support posts 210 by means of four rollers 214. Attached to each of the posts 210 is a rack 216. Each rack 216 is engaged by a pinion gear 218 which is fixed to a larger gear 220. The larger gears 220 are each driven by a chain 222. Each chain is connected to a gear 224 on one end of the axle 208 as shown in FIG. 1. It should be readily understood that as the segment core rotates with its axle 208, the rack and gear arrangement will move the coiled up segments along the support posts 210. Attached to each side of the core 206 is a sheave 226, each of which has a cable 228 wrapped around it. Each cable 228 is also wrapped around one of a pair of helically grooved drums 230 which are mounted between the side plates 30 on an axle 232. A spring motor 234 having a helically wound ribbon spring 236 tensions the cables 228. As each boom segment 10 is removed from around the core 206, the core 206 rotates with its axle 208 and moves along the support posts. As segments are removed from the core, the axle 208 is lowered which permits the boom segments 10 to be longitudinally aligned with the rollers in the boom support means 14. When the boom segments are being retracted and coiled into the storage assembly 12, the axis of the core is moved upwardly by means of the rack and gear arrangement.

The spring motor 234 provides a substantially constant force to tension the cable 228. As segments are removed from the core, the cables 228 are removed from the helically grooved drums 230 and the radius of the grooves of the drum 230 increases to counteract the increasing force provided by the spring motor 234. This provides a substantially constant tension on the cables 228 to assist in recoiling the boom segments.

Boom Pullover

FIG. 1 shows that the entire boom assembly can be pivoted about the pins 34 so that the entire assembly can be turned upside down, as indicated by the elements shown in phantom. An overbalance spring 250 provides assistance in moving the assembly. One end of the spring is fixed to the pin engaging one end of the hydraulic cylinder 38. The other end of the spring is moved horizontally by the slide and pivot mechanism 251 which slides along a rail 252. The entire boom assembly can be pivoted about the pins 34 to any elevation angle desired by means of the hydraulic cylinders 38.

Self-Raising

The boom assembly can be raised and lowered along the main support post 18. This is accomplished by lowering the end of the boom so that the longitudinal axis of the boom is positioned in a generally vertical direction. The boom segments are then either retracted or extended, causing entire assembly to be raised with respect to the support 55.

While a particular embodiment of the invention has been shown and described, it should be understood that the invention is not limited thereto since many modifications may be made. It is therefore contemplated to cover by the present application any and all such modifications that fall within the true spirit and scope of the basic underlying principles disclosed and claimed herein.

I claim:

1. A segmented extendible boom comprising:

a plurality of elongated, trough-like segments having truncated, V-shaped, transverse cross-sections of uniform size, each segment having a bottom and a pair of diverging sidewalls, the sidewalls projecting upwardly and outwardly from spaced-apart locations on the bottom to form the truncated, V-shaped cross-sections, each segment having an open end opposite the bottom, each segment having a longitudinal end at each longitudinally distant portion of the segment, the segments being connected longitudinal end to longitudinal end such that the open ends of the segment face in the same direction, the segments being aligned longitudinally to form a projecting boom arm when the boom is extended, the segments being progressively shorter in longitudinal length from the outer end to the inner end of the projecting boom arm, means pivotally interconnecting each segment to the next adjacent segment for pivoting the longitudinal axis of an adjacent segment about a transverse axis located at the abutting longitudinal ends of the segments near the open ends of the segments, thereby permitting segments not needed for the boom arm to be nested about one another with the bottoms of nested segments lying close together;

side flanges extending transversely outwardly from the upper end of the sidewalls opposite the bottom;

flexible tensional means fixedly interconnected to each of the side flanges for providing structural support to the boom segments for resisting pivotal downward movement of the segments about the transverse pivot axes when extended;

roller means engaging the side flanges above and below the side flanges for cantilevering the segments in an extended position; and means for extending and retracting the segments.

2. The boom of claim 1, said flexible tensional means including at least one cable at the outer transverse extremities of each flange.

3. The boom of claim 1, said means for pivotally connecting said segments including elastically extendible hinge means.

4. The boom of claim 1 wherein the side flanges include raised portions extending longitudinally along said flanges.

5. The boom of claim 1, including second flexible tensional means for supporting extended boom segments against pivotal movement about said transverse axes in the direction opposite the movement resisted by said first tensional means, a drum underlying the boom when extended, said second flexible tensional means being wrapped around said drum, and wherein the second flexible tensional means are unwrapped from the drum at the same linear speed as the extension speed of the boom.

6. The boom of claim 1, said segment pivotal interconnecting means including forward lateral side wedges on one end of each segment, rearward lateral side wedges on the opposite end of each segment, said forward wedges of one segment abutting the rearward wedges of the next adjacent segment for resisting relative side and longitudinal twisting movement of said segments, hinge means at the outer wider portion of the sidewalls of the segments interconnecting adjacent segments, and cam means on adjacent ends of adjacent segments abutting one another when the segmments are extended to resist longitudinal twisting and align the V-shaped segments in a common plane.

7. The boom of claim 1, said means for extending and retracting said segments including a plurality of longitudinally spaced, transversely aligned pins on the narrower ends of said segments, and a powered sprocket for engaging said pins to move the segments.

8. The boom of claim 1, including means for inverting said boom arm.

9. The boom of claim 1, including clip means on said segments for carrying power cables and the like to the outer end of the boom arm, and means for automatically feeding the power cables into the clip means when the boom arm is extended.

10. The boom of claim 1, including a transversely extending cross-member cconnected between said sidewalls of each segment.

11. The boom of claim 1, including means for coiling said segments in multiple wraps in a storage condition, said segments in an outer wrap in said coil nesting with the segments of an inner wrap, said segments in coiled condition forming a generally square configuration about central axle, said segments getting progressively smaller toward the inner end of the boom arm in sets of adjacent pairs so that the segments of the various adjacent wraps can nest smoothly.

12. The boom of claim 11, said coiling means including means for moving said central axle toward said roller means as said coil gets smaller during extension of the boom.

13. The boom of claim 11, including spring means coupled to said segments and winding up as the segments are extended for providing a return force to retract the segments.

14. A segmented extendible boom having longitudinal inner and outer ends and having a plurality of hingedly connected segments, a mechanism for extending the segments for forming the boom and for retracting the segments into a coil onto a storage reel, said storage reel being located during retraction and extension of the segments generally adjacent the longitudinal inner end of the boom, and means for supporting the extended segments for carrying a vertical load thereon, characterized by:

said segments having outwardly open, channel-shaped cross-sections capable of nesting within one another, said segments each being defined by flat sidewalls converging from outer, widely spaced ends to inner, closely spaced ends and joined at the inner spaced ends by a horizontal end wall, said segments being hinged together for nesting with the horizontal end walls and flat sidewalls of the segments adjacent and confronting one another when nested on the reel, and said segments having opposed abutment surfaces for supporting the segments in a cantilevered position when extended.

15. The boom of claim 14, further characterized by common flexible cables connected to each said segment for resisting side loads on said boom and for supporting vertical loads on said boom.

16. The boom of claim 15, further characterized by laterally extending flanges connected to said outer ends of the sidewalls, said flexible cables connected to each of said flanges, and rollers above and below the flanges and engaged therewith for cantilevering the segments in the extended position.

17. The boom of claim 14, further characterized by elastically extendible hinges connecting the segments together.

18. The boom of claim 14, further characterized by a second cable adjacent the opposite inner ends of the sidewalls for supporting the extended segments against pivotal movement about said hinges in the opposite direction for operating the boom in an extended inverted position.

19. The boom of claim 14, further characterized by said reel for storing said retracted segments including a rotatable reel axle, and means for adjusting the location of the axle relative to the horizontal centerline of the extended boom for moving the central axle toward the extended boom centerline as said coil of segments on said reel gets smaller during extension of said segments.

20. The boom of claim 14 wherein each segment transverse cross-section is uniform throughout its length.

* * * * *